United States Patent [19]

Lothmann et al.

[11] Patent Number: 4,586,773

[45] Date of Patent: May 6, 1986

[54] BIPARTITE ELECTRICAL CONNECTOR HOUSING

[75] Inventors: Werner Lothmann, Ascot; Leonard J. Owen, Watford; Reginald J. Simmons, South Harrow, all of England

[73] Assignee: AMP Incorporated, Harrisburg, Pa.

[21] Appl. No.: 673,700

[22] PCT Filed: Mar. 19, 1984

[86] PCT No.: PCT/US84/00443

§ 371 Date: Oct. 29, 1984

§ 102(e) Date: Oct. 29, 1984

[87] PCT Pub. No.: WO84/03803

PCT Pub. Date: Sep. 27, 1984

[51] Int. Cl.[4] ..... H01R 13/627

[52] U.S. Cl. ..... 339/91 R

[58] Field of Search ..... 339/91 R

[56] References Cited

U.S. PATENT DOCUMENTS

| | | | |
|---|---|---|---|
| 3,179,738 | 4/1965 | De Lyon | 339/91 R |
| 3,523,269 | 3/1968 | Witek, Jr. et al. | 339/91 |
| 3,869,191 | 3/1975 | Tolnar, Jr. et al. | 339/91 R |
| 3,933,406 | 1/1976 | Cameron et al. | 339/91 R |
| 4,010,998 | 3/1977 | Tolnar, Jr. et al. | 339/91 R |
| 4,026,624 | 5/1977 | Boag | 339/91 R |
| 4,273,403 | 6/1981 | Cairns | 339/91 R |
| 4,392,706 | 7/1983 | Baker et al. | 339/91 R |
| 4,448,467 | 5/1984 | Weidler | 339/91 R |

FOREIGN PATENT DOCUMENTS 2801427 7/1978 Fed. Rep. of Germany .

*Primary Examiner*—John McQuade

*Attorney, Agent, or Firm*—Thomas G. Terrell

[57] ABSTRACT

One of housing parts (1and 2) has ramps (15), which are engaged by projections (18) on latch arms (16) on the other housing part (2) to secure the housing parts (1 and 2) in mating relationship and thereby providing a force which assists the mating of the housing parts (1 and 2). In order to allow the arms (16) to be released from the ramps (15) by displacing only one of the arms (16), are ganged through a torsion spring (12) so that by depressing one arm (16) towards the mated housing parts (1 and 2), or by pulling the other arm (16) away from the mated housing parts (1 and 2), both of the arms (16) can be released from engagement with their associated ramps (15) simultaneously.

4 Claims, 8 Drawing Figures

FIG.2.
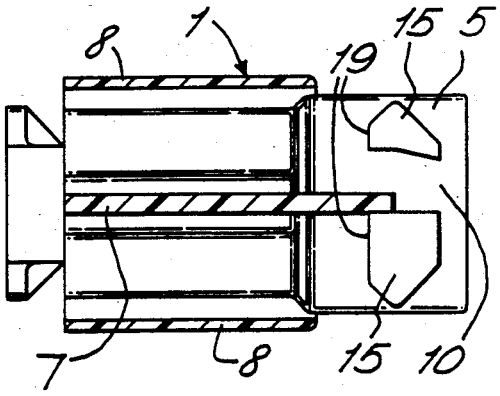
FIG.3.
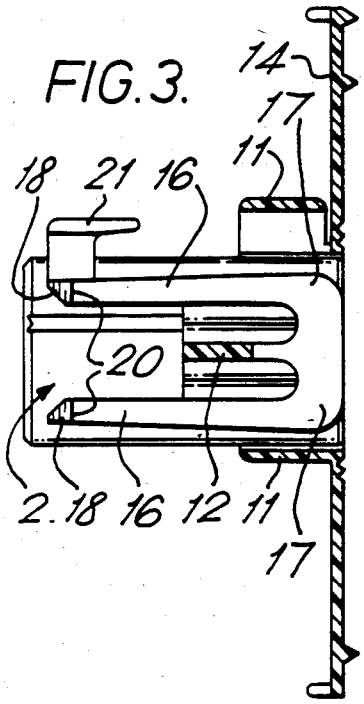
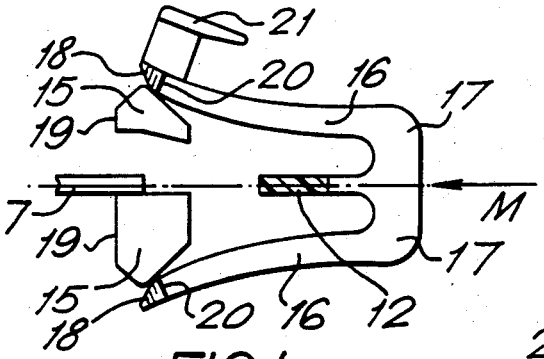
FIG.4.
FIG.5.
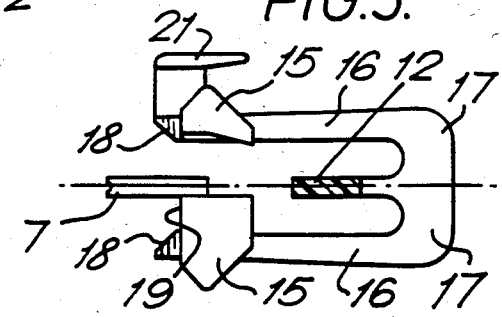

BIPARTITE ELECTRICAL CONNECTOR HOUSING

This invention relates to a bipartite electrical connector housing comprising first and second housing parts each for containing at least one electrical terminal, the housing parts being capable of being mated to mate the terminals when these are contained therein, the housing parts having interengaging latching members which provide a force which assists in the mating of the two housing parts and which serve to secure them together in their mated condition, the latching members comprising a ramp on each of two opposite sides of the first housing part, and a resilient cantilever arm on each of two opposite sides of the second housing part, each arm carrying a projection adapted and arranged to ride over a ramp on the first housing part as the housing parts are mated.

Such a bipartite housing is disclosed in U.S. Pat. No. 4,026,624, in which the problem of unmating the first and second housing parts has been approached by splitting each arm on the second housing part into two parts and giving the projections on the arms and the ramps, camming surfaces which engage when the housing parts are being unmated to separate the two parts of each arm such that they pass on opposite sides of the associated ramp rather than having to pass back over the ramp.

However, the engagement between the camming surfaces offers a resistance to unmating, albeit that this resistance can be less than that which would occur if the projections on the arms had to pass back over the ramps.

In U.S. Pat. No. 3,933,406 there is disclosed a similar bipartite housing save that the ramps on the first housing part and the projections on the arms of the second housing part have cooperating surfaces which engage when the housing parts are fully mated, to prevent unmating of the housing parts. The arm parts have extensions directed away from the ramps and being adapted and arranged such that by squeezing the free ends of the arm part extensions together, the cooperating surfaces on the ramps and on the projections on the arms can be disengaged to permit the projections to pass back on opposite sides of the associated ramp to permit unmating.

However, here again the latching arrangement offers some resistance to unmating, and has the further disadvantage that the provision of the arm extensions takes up additional space. Unmating is also difficult since two hands are required to operate the unlatching arrangement, it thus being necessary for the first housing part to be supported in some way while the second housing part is pulled away therefrom.

In EP-A-0039548 there is disclosed a bipartite housing as discussed above in which the ramps are supported on the first housing part such that deflection of the arms of the second housing part towards the first housing part when the housing parts are mated disengages the cooperating surfaces of the ramps and projections and enables the housing parts to be unmated with the projections on the arms of the second housing part passing under the ramps on the first housing part.

This known bipartite housing has the advantage that the two housing parts are positively secured in the mated condition, so that unmating is impossible until the latching members are appropriately manipulated, when the two housing parts can be easily unmated.

However, access is needed to both sides of the mated housings to manipulate the latching members to effect unlatching, and in certain circumstances such access may not be available, especially where the connector is located in a part of an automobile where the space available is very limited.

Latching at two sides of an assembly is preferable to ensure reliability, and thus this disadvantage cannot be overcome simply by providing a latching arrangement on only one side of an assembly.

According to this invention a bipartite electrical connector housing comprising first and second housing parts each containing at least one electrical terminal, the housing parts being capable of being mated to mate the terminals when these are contained therein, the housing parts having interengaging latching members which provide a force which assists the mating of the two housing parts and which serve to secure them together in their mated condition, the latching members comprising a ramp on each of two opposite sides of the first housing part, and a resilient cantilever arm on each of two opposite sides of the second housing part, each arm carrying a projection adapted and arranged to ride over a corresponding ramp on the first housing part as the two housing parts are mated, the ramps on the first housing part and the projections on the arms of the second housing part having cooperating surfaces which engage when the housing parts are fully mated, to prevent unmating of the housing parts, is characterized in that the arms on the second housing part are ganged through a common torsion spring member, the ramp on one side of the first housing part being such that deflection of the associated arm of the second housing part towards the first housing part when the housing parts have been mated, which deflection causes twisting of the torsion spring member, disengages the cooperating surfaces of the ramp and the associated projection at said one side of the first housing part, and is accompanied by deflection of the arm on the other side of the second housing part away from the first housing part to disengage the cooperating surfaces of the ramp and associated projection at said other side of the second housing part, to permit the housing parts to be unmated, with the projection at said one side passing under its associated ramp, and the projection on said other side passing over its associated ramp.

Twisting of the torsion member can be effected either by urging the arm at said one side towards the first housing part, or by urging the arm at said other side away from the first housing part.

The bipartite housing of this invention has the advantages that positive mating of the housing parts is ensured; positive latching together of the housing parts in the mated condition at two opposed sides is ensured; unlatching of the housing parts can be effected easily when required; and unlatching of the housing parts requires access to only one side of the mated parts.

An electrical connector assembly comprising embodiments of a bipartite connector housing according to this invention will now be described by way of example with reference to the drawings in which:

FIG. 2 is a longitudinal sectional view through one housing part of the assembly;

FIG. 3 is a longitudinal sectional view through the other housing part of the assembly;

FIG. 4 is a diagrammatic view of the latching arrangement of the assembly during mating of the housing parts;

FIG. 5 is a diagrammatic view of the latching arrangement of the assembly in the latched condition;

Figure 1:
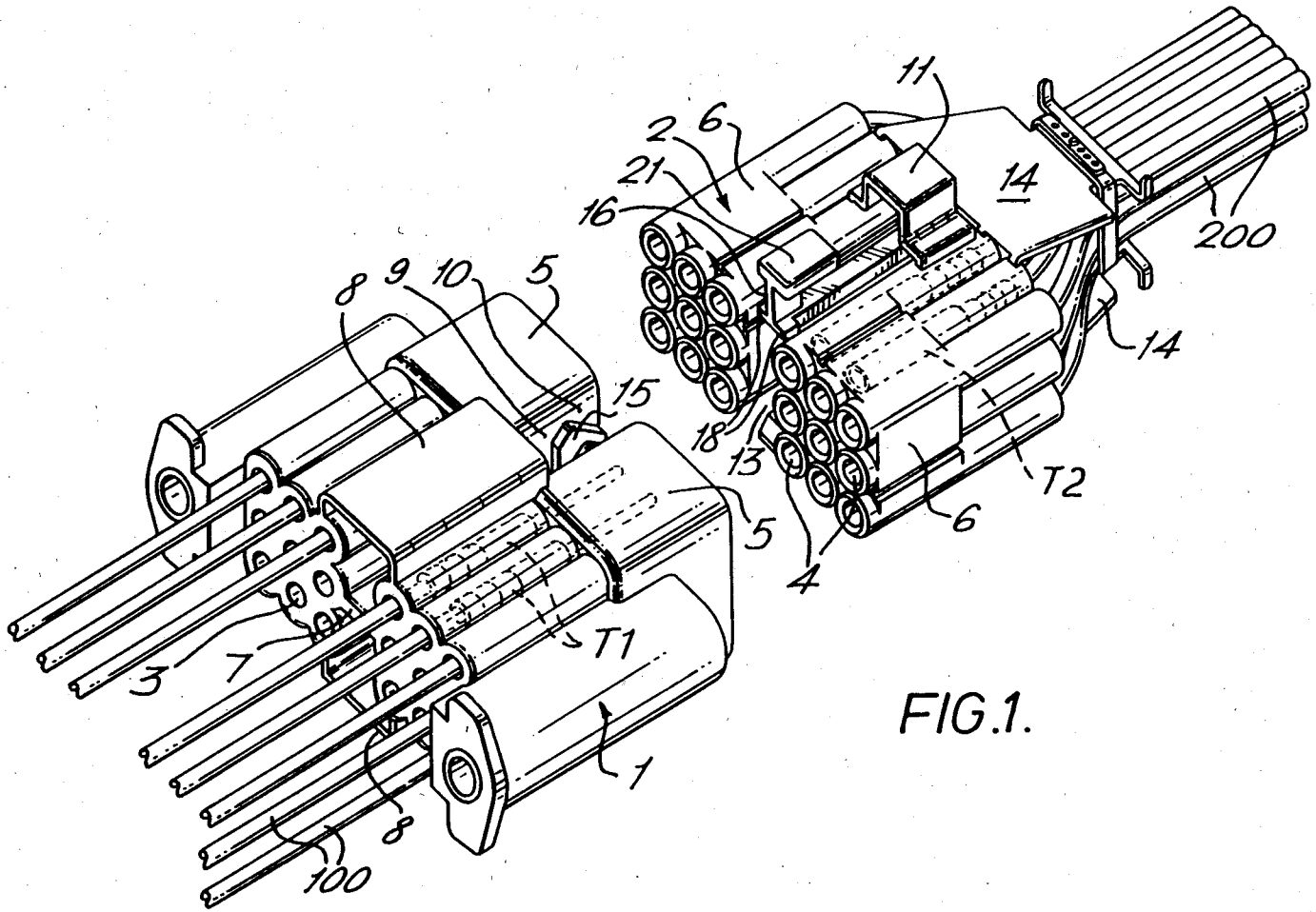
FIG. 1 is a perspective view of the assembly showing the housing parts in the unmated condition.

The connector assembly shown in FIG. 1 comprises a bipartite insulating connector housing consisting of housing parts 1 and 2 each containing electrical terminals T1 or T2 terminating individual electrical conductors 100 or 200, the housing parts 1 and 2 being capable of being mated to mate the terminals T1 and T2 when these are contained in the housing parts.

The housing parts 1 and 2 are each molded from electrically insulating plastic material, and each has two spaced groups of nine tubes defining through cavities 3 or 4 containing the terminals T1 or T2 (only a few of which are shown), the leading ends of the tubes defining the cavities 3 in the housing part 1 opening into shroud portions 5 which receive leading end portions 6 of the tubes defining the cavities 4 in the housing part 2, when the housing parts are mated.

The two groups of tubes defining the cavities 3, and the associated shroud portions 5 of the housing part 1, are connected by a central web portion 7 (FIG. 1) and opposed U-section outer web portions 8, so that a space 9 is provided between the opposed inner surfaces 10 of the shroud portions 5.

The two groups of tubes defining the cavities 4 of the housing part 2 are connected by outer web portions 11 and by a torsion spring member 12 so that a space 13 is provided between the two groups of cavities 4.

The housing part 2 is also formed with a strain relief arrangement comprising a pair of hingedly connected flaps 14 which can be closed and secured together about the conductors 200.

The housing parts 1 and 2 have interengaging latching members which provide a force which assists the mating of the housing parts and which serve to secure the housing parts together in their mated condition.

The latching members comprise on the housing part 1, a pair of ramps 15 formed on the opposed inner surfaces 10 of each of the shroud portions 5, and on the housing part 2, a pair of resilient cantilever arms 16 connected by bight portions 17 to the rearward edge of the torsion spring member 12 and extending forwardly in the space 13 between the two groups of tubes defining the cavities 4. At its free end, each arm 16 carries two cam projections 18 each adapted and arranged to ride over one of the ramps 15 on the housing part 1, the ramps 15 and the projections 18 having cooperating surfaces 19 and 20 respectively which engage when the housing parts 1 and 2 are fully mated, to prevent unmating of the housing parts, as will all be described below.

One of the arms 16 is also formed at its free end with a pushbutton 21 by which the arm can be depressed to unlatch the housing parts 1 and 2, as will also be described below.

Mating of the housing parts 1 and 2 will now be described with reference to FIGS. 4 and 5.

As shown in FIG. 4, as the housing parts are mated in the direction of the arrow M, the projections 18 on the arms 16 ride up forwardly facing surfaces of the associated ramps 15, thus causing resilient outward deflection of the arms 16. If the mating force is removed before the projections 18 reach the peaks of the ramps 15 the housing parts will be urged apart again by the forces induced in the arms 16 by their deflection.

When the projections 18 pass over the peaks of the associated ramps 5 and engage rearwardly facing surfaces thereof, the forces induced in the arms 16 by their deflection serve to urge the housing parts towards each other and thus assist in ensuring that the housing parts become positively mated.

As shown in FIG. 5, when the housing parts are fully mated the projections 18 are engaged behind the associated ramps 15 with their surfaces 20 and 19 in engagement, thereby preventing unmating of the housing parts.

Figure 6:
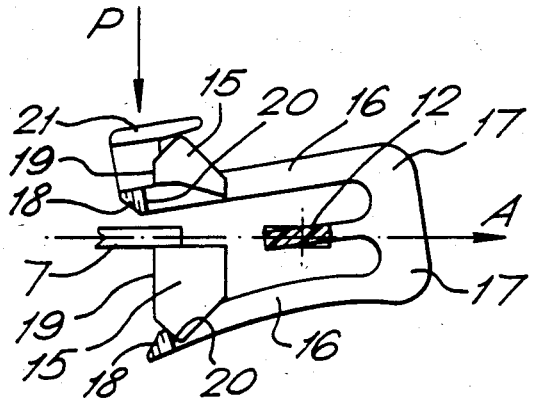
FIG. 6 is a diagrammatic view of the latching arrangement of the assembly at unmating of the housing parts.
Figure 7:
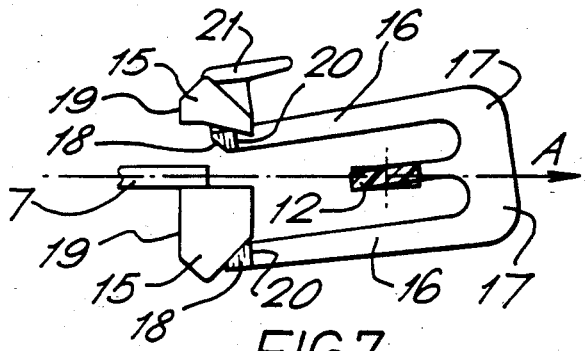
FIG. 7 is a diagrammatic view of the latching arrangement of the assembly during unmating of the housing parts.

When, as shown in FIGS. 6 and 7, it is desired to unmate the housing parts, the pushbutton 21 is depressed, as indicated by the arrow P in FIG. 6, thereby to disengage the surfaces 19 and 20 of the ramps 15 and projections 18. The arm 16 which carries the pushbutton 21 (the upper arm in FIG. 6) is deflected directly by the applied force, this deflection causing twisting of the torsion spring member 12 which carries the arms 16 and through which they are ganged. This twisting of the torsion spring member 12 causes the other arm 16 (the lower arm 16 in FIG. 6) to be deflected so that the surfaces 20 of the projections 18 thereon are moved out of engagement with the surfaces 19 of the associated ramps 15. The housing parts can then be pulled apart in the direction of the arrow A in FIGS. 6 and 7, the projections 18 on the arm 16 carrying the pushbutton 21 passing under the associated ramps 15, and the projections 18 on the other arm 16 passing back over the associated ramps 15.

When the projections 18 are finally clear of the associated ramps 15 the torsion spring member 12 untwists and returns to its rest condition, so that the arms 16 are returned to their initial position.

Figure 8:
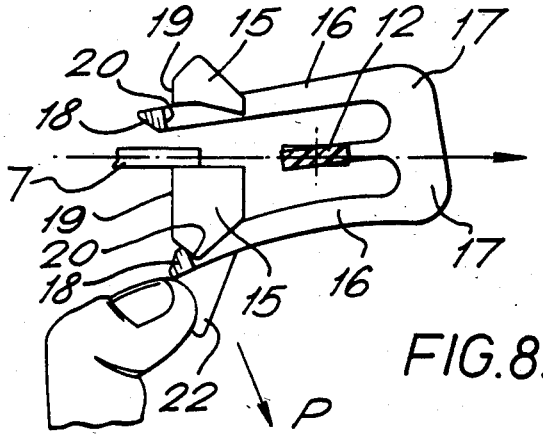
FIG. 8 is a diagrammatic view similar to FIG. 6 but showing a modified form of the latching arrangement of the assembly.

FIG. 8 shows a modification of the latching arrangement shown in FIGS. 1 to 7. As shown in FIG. 8, a finger grip 22 is provided on the other arm 16, that is the lower arm 16 in the drawing. With this modified arrangement, the mating of the housing parts 1 and 2 and their latching in the mated condition is as above described with reference to FIGS. 4 and 5. However, unmating is effected by pulling the finger grip 22, and thus the arm 16 on which it is provided, away from the housing parts, as indicated by the arrow P in FIG. 8, so that the projections 18 on the other, lower arm 16 pass back over the associated ramps 15 while the induced twisting of the torsion member 12 disengages the projections 18 on the upper arm 16 from the associated ramps 15 so that they can pass under the ramps 15 as the housing parts are unmated, as shown in FIG. 7.

Both the above described embodiments have the particular advantage that, while secure latching together of the housing parts 1 and 2 in the mated condition is provided on two sides of the assembly, unlatching of the parts 1 and 2 can readily be effected, even when there is access to only one side of the assembly as may be the case, for example, where the assembly is located amongst crowded other parts, for example, in the electrical system of an automobile.

We claim:

1. A bipartite electrical connector housing comprising first and second housing parts each for containing at least one electrical terminal, the housing parts being capable of being mated to mate the terminals when these are contained therein, the housing parts having interengaging latching members which provide a force which assists the mating of the housing parts and which serve to secure them together in their mated condition, the latching members comprising a ramp on each of two opposite sides of the first housing part, and a resilient cantilever arm on each of two opposite sides of the second housing part, each arm carrying a projection adapted and arranged to ride over a corresponding ramp on the first housing part as the housing parts are mated, the ramps on the first housing part and the projections on the arms of the second housing part having cooperating surfaces which engage when the housing parts are fully mated, to prevent unmating of the housing parts, wherein the arms on the second housing part are ganged through a common torsion spring member, the ramp on one side of the first housing part being so shaped that deflection of the associated arm of the second housing part towards the first housing part when the housing parts have been mated, which deflection causes twisting of the torsion spring member disengages the cooperating surfaces of the ramp and the associated projection at said one side of the first housing part and is accompanied by deflection of the arm on the other side of the second housing part away from the first housing part and is accompanied by deflection of the arm on the other side of the second housing part away from the first housing part to disengage the cooperating surfaces of the ramp and the associated projection at said other side of the second housing part, to permit the housing parts to be unmated, with the projection at said one side passing under its associated ramp, and the projection at said other side passing over its associated ramp.

2. A bipartite electrical connector housing to claim 1, wherein the arm on the one side of the second housing part is provided with a pushbutton which can be depressed to deflect said arm towards the first housing part, in the mated condition of the housing parts.

3. A bipartite electrical connector housing according to claim 1, wherein the arm on the other side of the second housing part is provided with a finger grip which can be pulled to move said arm away from the first housing part, in the mated condition of the housing parts, thereby to deflect the arm on the one side of the second housing part towards the housing part.

4. A bipartite electrical connector housing according to claim 2, wherein the torsion spring member connects two spaced portions of the second housing.

* * * * *